US009335664B2

(12) United States Patent
Tokudome et al.

(10) Patent No.: US 9,335,664 B2
(45) Date of Patent: May 10, 2016

(54) DEVELOPER CONTAINER, DEVELOPING DEVICE, PROCESS CARTRIDGE AND IMAGE FORMING APPARATUS

(71) Applicant: CANON KABUSHIKI KAISHA, Tokyo (JP)

(72) Inventors: Makoto Tokudome, Yokohama (JP); Ryosuke Kanai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/630,873

(22) Filed: Feb. 25, 2015

(65) Prior Publication Data

US 2015/0248079 A1 Sep. 3, 2015

(30) Foreign Application Priority Data

Feb. 28, 2014 (JP) ..... 2014-038084

(51) Int. Cl.
*G03G 15/08* (2006.01)

(52) U.S. Cl.
CPC ..... *G03G 15/0898* (2013.01); *G03G 15/0882* (2013.01)

(58) Field of Classification Search
CPC ..... G03G 15/08
USPC ..... 399/103
See application file for complete search history.

(56) References Cited

U.S. PATENT DOCUMENTS

| | | | | |
|---|---|---|---|---|
| 7,630,678 | B2 | 12/2009 | Kishi et al. | |
| 7,773,934 | B2 | 8/2010 | Kishi et al. | |
| 8,989,629 | B2 | 3/2015 | Kishi et al. | |
| 2013/0028630 | A1* | 1/2013 | Ito et al. | 399/103 |
| 2014/0003845 | A1 | 1/2014 | Tokudome et al. | |
| 2014/0212166 | A1* | 7/2014 | Takeuchi et al. | 399/106 |
| 2014/0348535 | A1* | 11/2014 | Murakami et al. | 399/106 |
| 2015/0016843 | A1 | 1/2015 | Kawasaki et al. | |

FOREIGN PATENT DOCUMENTS

| | | | | |
|---|---|---|---|---|
| JP | H08-292634 A | | 11/1996 | |
| JP | H08-292636 A | | 11/1996 | |
| JP | H08292634 | * | 11/1996 | G03G 15/08 |

* cited by examiner

*Primary Examiner* — Clayton E LaBalle
*Assistant Examiner* — Kevin Butler
(74) *Attorney, Agent, or Firm* — Fitzpatrick, Cella, Harper & Scinto

(57) ABSTRACT

A developer container includes: an accommodating chamber, provided with an opening for permitting discharge of a developer; and developer feeding means. The developer feeding means includes: a rotatable member; a developer feeding member fixed on the rotatable member; a sealing member for opening the opening by the rotation of the rotatable member, wherein one end portion thereof is fixed on the rotatable member and the other end portion thereof is provided so as to seal the opening; and a regulating portion for regulating the sealing member, which is wound about the rotatable member after the opening is opened by the rotation of the rotatable member, so as to expose a feeding surface of the developer feeding member.

10 Claims, 10 Drawing Sheets

(a)

(b)

(a)

(b)

(a)

(b)

DEVELOPER CONTAINER, DEVELOPING DEVICE, PROCESS CARTRIDGE AND IMAGE FORMING APPARATUS

FIELD OF THE INVENTION AND RELATED ART

The present invention relates to a developer container, a developing device, a process cartridge and an image forming apparatus.

The developer container discharges a developer, accommodated in an accommodating chamber, through an opening of the accommodating chamber by a developer feeding means. The developing device is prepared by integrally providing a developer carrying member and the developer container.

The developer container is prepared by integrally assembling at least an image bearing member, the developer carrying member and the developer container into a cartridge (unit), which is detachably mountable to the image forming apparatus.

The image forming apparatus includes the developer container, and forms an image on a recording material (medium) such as recording paper by using an image forming process. Examples of the image forming apparatus may include a copying machine, a printer, a facsimile machine and a multifunction machine (printer) having functions of these machines.

An electrophotographic image forming apparatus such as the copying machine or a laser beam printer will be described as an example. In the image forming apparatus, an electrostatic image is formed by irradiating an electrophotographic photosensitive member (image bearing member) with light corresponding to image data. Then, the electrostatic image is supplied with a toner of a developer as a recording agent from the developing device, and thus is visualized as a toner image. This toner image is transferred from the photosensitive member onto the recording material such as the recording paper by a transfer device. The toner image is fixed on the recording material by a fixing device, so that a recording image is formed.

As the developing device using the developer, those of various types have been proposed. For example, Japanese Laid-Open Patent Application (JP-A) Hei 8-292634 discloses a developing device including a developing chamber having a developing roller and an accommodating chamber, provided adjacently to the developing chamber, for supplying the toner to the developing chamber. In JP-A Hei 8-292634, an opening is formed between the developing chamber and the accommodating chamber and is sealed up with a sealing member before start of use of the image forming apparatus. An end of the sealing member is mounted on an end portion of a developer feeding member in the accommodating chamber, and when the developer feeding member rotates, the sealing member is peeled and the opening is opened, so that the toner is movable and usable. The developer feeding member is constituted by a toner feeding sheet and a rotation shaft portion.

By employing the above-described constitution, the sealing member remains in the developing device, and therefore there is no need that a user disposes of the sealing member. Further, the user is not required to unseal the sealing member, and therefore usability is improved.

In FIG. 9, (a) and (b) show an example of a developer feeding member 12 to which a technique of JP-A Hei 8-292636 is applied. As shown in FIG. 9, the developer feeding member 12 is constituted by a rotation shaft portion 17, a toner feeding sheet 13 mounted on the rotation shaft portion 17, and a sealing member 15 having one end portion mounted on the rotation shaft portion 17. The other end portion of the sealing member 15 seals an opening (not shown) of an accommodating portion in which the developer is accommodated.

The sealing member 15 rotates, after the opening (not shown) is unsealed (opened) by rotation of the rotation shaft portion 17, in an arrow B direction together with the developer feeding member 12 while receiving a self-weight G of a toner T as shown in FIG. 9. For example, in the case of a process cartridge including the developer feeding member 12, a repelling force of the sealing member 15 lowers as a lifetime of the cartridge approaches the latter half thereof.

As a result, as shown in (a) and (b) of FIG. 9, as the lifetime of the sealing member 15 standing from an initial stage nears the latter half thereof, the sealing member 15 gradually winds about the developer feeding member 12, so that a region C where the sealing member 15 covers the toner feeding sheet 13 gradually increases.

Such a problem resulting from the covering of the toner feeding sheet 13 with the sealing member 15 will be described with reference to (a) and (b) of FIG. 9. At the initial stage of the sealing member 15 after unsealing, as shown in (a) of FIG. 9, the sealing member 15 does not wind about the developer feeding member 12. For that reason, a surface (feeding surface) of the toner feeding sheet 13 is not covered with the sealing member 15, so that only a vector F of a force directed in a direction perpendicular to the surface (feeding surface) of the toner feeding sheet 13 acts on the toner T on the toner feeding sheet 13. Therefore, the toner can be fed.

On the other hand, in the latter half lifetime of the cartridge, as shown in (b) of FIG. 9, the sealing member 15 winds about the developer feeding member 12, so that the surface (feeding surface) of the toner feeding sheet 13 is covered with the wound sealing member 15 (region C). In the region C of the toner feeding sheet 13 covered with the wound sealing member 15, an angle θ is formed between the surface of the toner feeding sheet 13 and an opposing surface of the sealing member 15 opposing the toner feeding sheet 13.

For that reason, a vector F sin θ of a force directed in a direction parallel to the surface of the toner feeding sheet 13 acts on the toner on the sealing member 15. As a result, it turned out that the toner on the sealing member 15 is moved toward the free end of the sealing member 15 by the vector F sin θ, and thus (toner) feeding power of the toner feeding sheet 13 lowers.

That is, as the lifetime of the process cartridge nears the latter half thereof and the region C in which the toner feeding sheet 13 is covered with the sealing member 15 increases, the feeding power of the toner feeding sheet 13 lowers. As a result, in sufficient toner supply by the toner feeding sheet 13 generated, so that an image density lowered in the latter half lifetime of the process cartridge in some cases.

The sealing member 15 which is mounted on the rotation shaft portion 17 at one end portion thereof and which seals the opening (not shown) at the other end portion thereof is required to have a mounting length while ensuring loosening so as not to apply tension thereto, and therefore it was difficult to shorten the sealing member 15.

SUMMARY OF THE INVENTION

A principal object of the present invention is to suppress a lowering in feeding power of a developer feeding member in the latter half lifetime while maintaining a necessary length of a sealing member.

According to an aspect of the present invention, there is provided a developer container comprising: an accommodating chamber, provided with an opening for permitting discharge of a developer, for accommodating the developer; and developer feeding means for discharging the developer accommodated in the accommodating chamber through the opening by rotation, wherein the developer feeding means includes: a rotatable member; a developer feeding member, fixed on the rotatable member, for discharging the developer accommodated in the accommodating chamber through the opening by rotation of the rotatable member; a sealing member for opening the opening by the rotation of the rotatable member, wherein one end portion thereof is fixed on the rotatable member and the other end portion thereof is provided so as to seal the opening; and a regulating portion for regulating the sealing member, which is wound about the rotatable member after the opening is opened by the rotation of the rotatable member, so as to expose a feeding surface of the developer feeding member.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be specifically described with reference to the drawings. Dimensions, materials, shapes and relative arrangements of constituent elements described in the following embodiment should be appropriately be changed depending on structures and various conditions of devices (apparatuses) to which the present invention is applied. Accordingly, the scope of the present invention is not intended to be limited to the following embodiments unless otherwise specified.

Embodiment 1

Image Forming Apparatus

Figure 2:
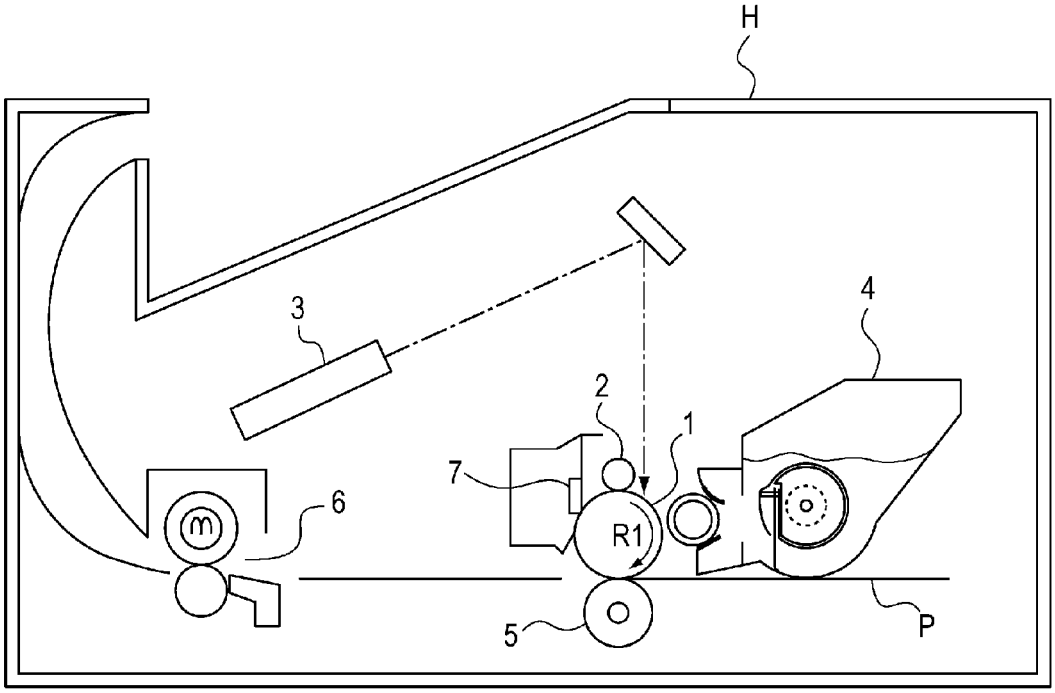
FIG. 2 is a schematic illustration of an image forming apparatus including the developing device in Embodiment 1.

FIG. 2 is a sectional view of an image forming apparatus H including a developing device 4 having a developer container in this embodiment. An operation of the image forming apparatus H having the above-described constitution will be described with reference to FIG. 2. The developing device 4 including the developer container according to the present invention will be described later. In the following description, a rotational axis direction of a photosensitive drum 1 is a longitudinal direction, and a direction perpendicular to the longitudinal direction is a short direction.

As shown in FIG. 2, the image forming apparatus H includes the photosensitive drum (image bearing member) 1 rotatable in an arrow R1 direction by an unshown driving means. By applying a DC voltage from an unshown power source to a charging device 2 contacting the surface of the photosensitive drum 1, the surface of the photosensitive drum 1 is electrically charged to a predetermined potential (−500 V in this embodiment). The charged surface of the photosensitive drum 1 is irradiated with light emitting in an image exposure manner by an optical system including a semiconductor laser 3 which is turned on by receiving an image signal, so that an electrostatic latent image is formed on the surface of the photosensitive drum 1. The electrostatic latent image formed on the photosensitive drum 1 is developed by the developing device 4 including the developer container in this embodiment.

On the other hand, a transfer-receiving material (recording material) P such as recording paper is fed one by one from an unshown cassette by a feeding roller. The transfer-receiving material P is synchronized with a toner image on the photosensitive drum 1 by an unshown registration roller pair, and then is fed to a transfer device 5. By the action of the transfer device 5, the toner image is transferred from the photosensitive drum 1 onto the transfer-receiving material P. Then, the transfer-receiving material P on which the toner image is transferred is fed into a fixing device 6, in which the toner image is fixed under application of heat and pressure, and then the transfer-receiving material P finally discharged to an outside of the image forming apparatus H.

The toner remaining on the photosensitive drum 1 without being transferred onto the transfer-receiving material P in a transfer step is removed by a cleaning device 7 including a rubber blade, and then the surface of the photosensitive drum 1 is electrically charged again by the charging device 2 and is repetitively subjected to the above-described steps.

In this embodiment, the photosensitive drum 1, the charging device 2, the developing device 4 and are integrally assembled to form a process cartridge, and this process cartridge is detachably mountable to an apparatus main assembly of the image forming apparatus H.

<Developing Device>

Figure 1:
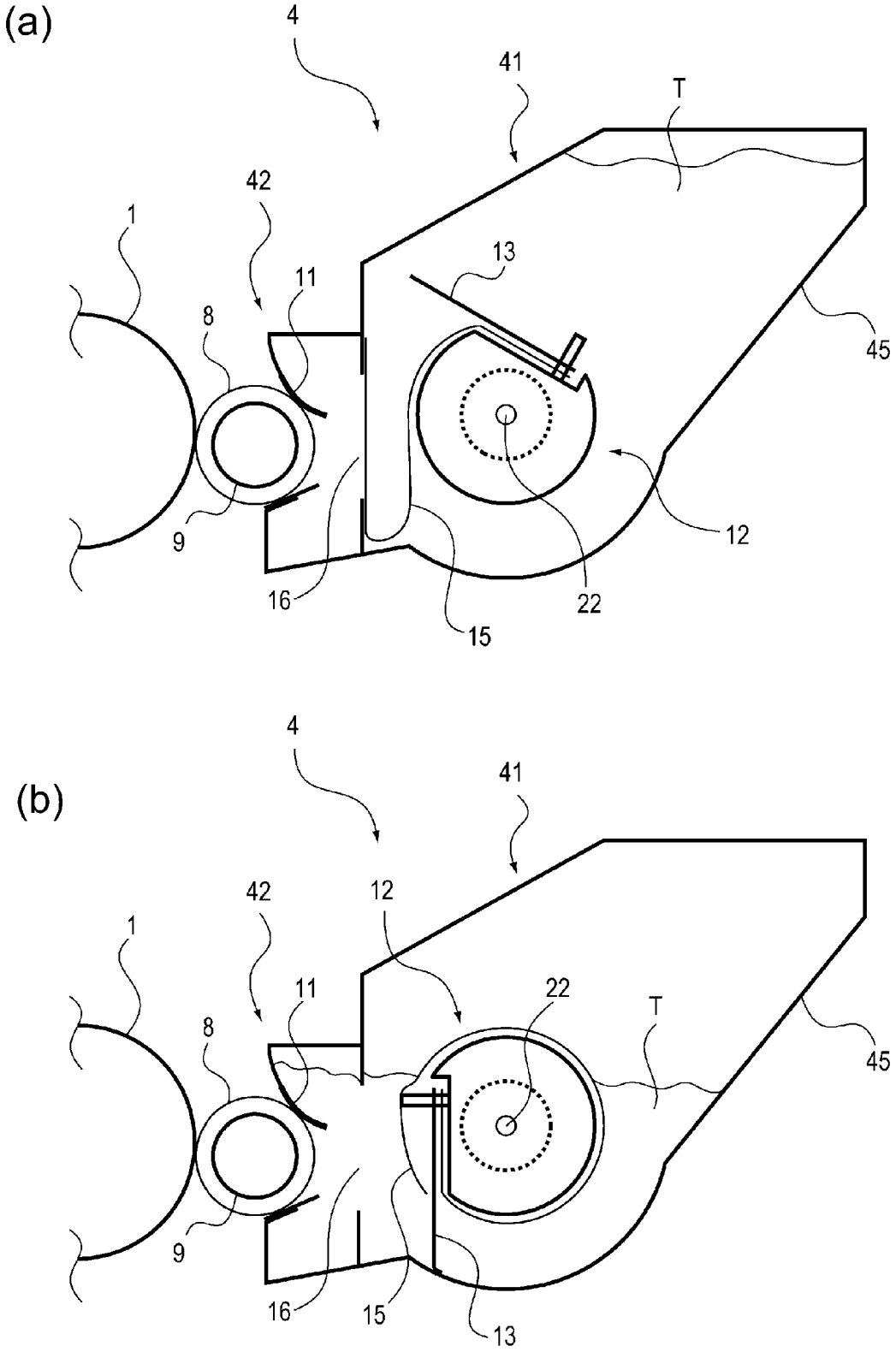
In FIG. 1, (a) and (b) are cross-sectional views of a developing device in Embodiment 1.

In FIG. 1, (a) and (b) are cross-sectional views of the developing device 4 including the developer container in this embodiment. The developing device 4 including the developer container in this embodiment will be described with reference to (a) and (b) of FIG. 1. In the developing device 4, a toner accommodating chamber 41 for accommodating the toner (developer) T. In this embodiment, as the developer, an insulating one-component magnetic toner was used. The toner accommodating chamber 41 is an accommodating chamber, accommodating the toner therein, having a toner supply opening 16 for permitting discharge of the toner.

As shown in (a) of FIG. 1, in an unused state, the toner supply opening 16 of the developing device 4 is sealed up with a sealing member 15. After the sealing member 15 is unsealed, the toner T in the toner accommodating chamber 41 is stirred by rotation of a developer feeding member 12 provided in the toner accommodating chamber 41, and is fed into a developing chamber 42. The developer feeding member 12 is a developer feeding means for discharging the toner, accommodated in the toner accommodating chamber 41, through the opening 16 while stirring the toner.

In this embodiment, the developer container included in the developing device 4 is contacted by the toner accommodating chamber 41 and the developer feeding member 12 which are described above. The developing device 4 is constituted by the developer container and members, described later, consisting of a developing sleeve 8, a developing blade 11 and a toner developing chamber 42.

An unsealing method of the sealing member 15 and an unsealing operation of the sealing member 15 by the developer feeding member 12 will be specifically described. The developer feeding member 12 in this embodiment will be described later.

Figure 5:
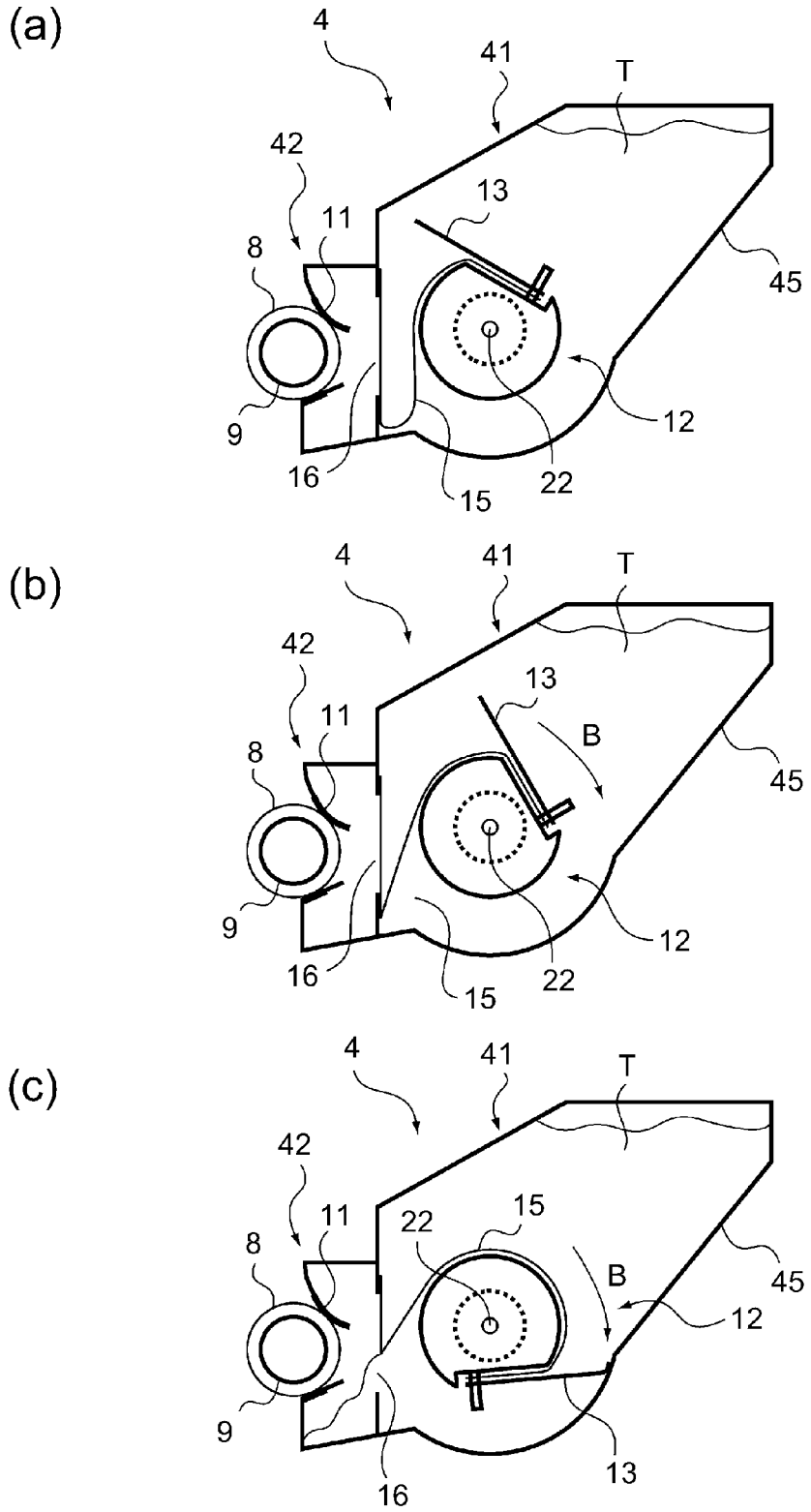
In FIG. 5, (a), (b) and (c) are illustrations of an unsealing operation of a sealing member in Embodiment 1.

In FIG. 5, (a) to (c) are sectional views showing a process in which the sealing member 15 is gradually unsealed at the opening 16. As shown in (a) of FIG. 5, during sealing, the opening 16 is sealed up by the sealing member 15 while ensuring loosening of the sealing member 15.

As a result, the loosening is ensured even when a force acts on the developer feeding member 12 during assembling and transportation of the process cartridge, and therefore no tension is applied to the sealing member 15, s that a sealing force is maintained. The sealing member 15 is peelably fixed along an edge of the toner supply opening 16 by (thermal) welding or the like. A method of forming a sealing portion of the sealing member 15 may also be a method other than the welding, and the sealing member 15 can also be peelably fixed by, e.g., bonding, laser welding or the like.

When the process cartridge is mounted in the main assembly of the image forming apparatus H and receives drive (driving force) from the main assembly, the developer feeding member 12 rotates in an arrow B direction. When the developer feeding member 12 rotates in the arrow B direction, as shown in (b) of FIG. 5, the sealing member 15 is wound up by the developer feeding member 12, so that tension is applied to the sealing member 15.

When the developer feeding member 12 further rotates, as shown in (c) of FIG. 5, the sealing member 15 is peeled off from the toner supply opening 16. As a result, the toner supply opening 16 is unsealed (opened), so that the toner T is supplied from the toner accommodating chamber 41 to the toner developing chamber 42 through the toner supply opening 16 by the developer feeding member 12.

Then, the toner T is, as shown in (b) of FIG. 1, carried on the surface of the developing sleeve 8 as a developer carrying member for supplying the toner T from the toner developing chamber 42 to the surface of the photosensitive drum 1. A layer thickness of the toner T carried on the surface of the developing sleeve 8 is regulated while triboelectrically charging the toner T by the developing blade 11.

A predetermined gap (spacing) is formed by a gap-holding member between the developing sleeve 8 and the photosensitive drum 1, and was set at 300 μm in this embodiment. To the developing sleeve 8, an unshown power source is connected. The power source forms a predetermined electric field between the photosensitive drum 1 and the developing sleeve 8 by applying a voltage to the developing sleeve 8 in order to visualize the electrostatic latent image, formed on the surface of the photosensitive drum 1, with the toner T in a reverse development manner. In this embodiment, a rectangular voltage in the form of a DC voltage of −250 V biased with an AC voltage of 1700 Vpp in peak-to-peak voltage and 2400 Hz in frequency is applied.

By applying the voltage to the developing sleeve 8, the toner T can be moved (transferred) between the photosensitive drum 1 and the developing sleeve 8. In this way, the toner T negatively charged on the developing sleeve 8 is electrostatically attracted to a latent image portion of the photosensitive drum 1, so that the latent image is developed, and thus an image is formed. By repeating this step, in the latter half lifetime of the process cartridge, as shown (b) of FIG. 1, the sealing member 15 is in a state in which the sealing member 15 is wound about the developer feeding member 12.

<Developer Feeding Member>

Figure 3:
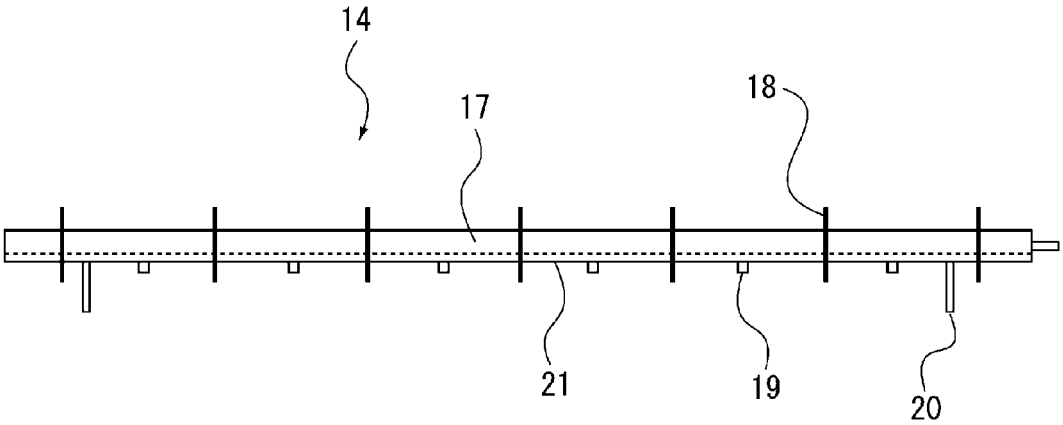
In FIG. 3, (a) is a schematic longitudinal view of a rotatable member in Embodiment 1, and (b) is a cross-sectional view of a developer feeding member in Embodiment 1.
Figure 3:
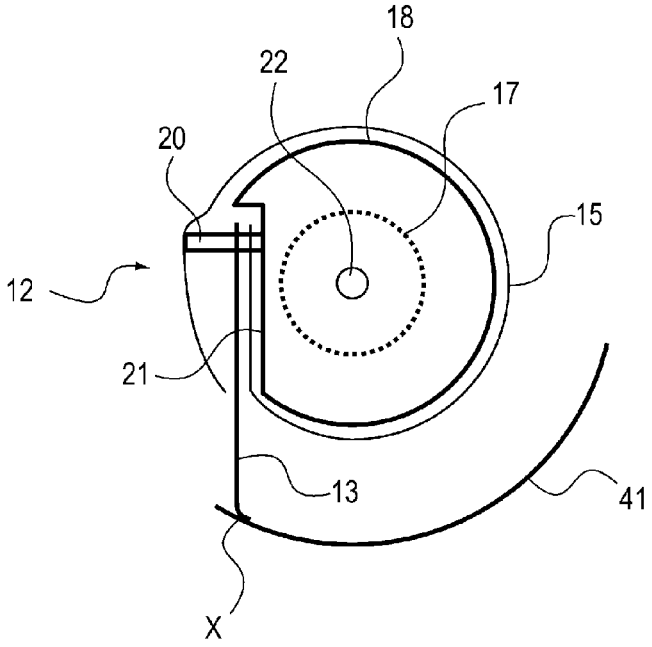

The developer feeding member 12 is constituted by the toner feeding sheet 13, the rotatable member 14, the sealing member 15 and regulating portions (limiting portions) 18 and 20 provided on the rotatable member 14. In FIG. 3, (a) is a schematic longitudinal view of the rotatable member 14 in this embodiment, and (b) is a cross-sectional view of the developer feeding member 12 in the latter half lifetime of the process cartridge in this embodiment. The developer feeding member 12 in this embodiment will be described with reference to (a) and (b) of FIG. 1 and (a) and (b) of FIG. 3.

The developer feeding member 12 is, as shown in FIG. 1, a rotatable member which is rotatable about a rotation center 22 and which is capable of stirring the toner T in the toner accommodating chamber 41, and functions as an unsealing member for unsealing (opening) the toner supply opening 16 by peeling the sealing member 15 which seals up the toner supply opening 16 in an unsealable manner. After the sealing member 15 is unsealed, the developer feeding member 12 has the function of feeding the toner T from the toner accommodating chamber 41 to the toner developing chamber 42 by the toner feeding sheet 13.

The rotatable member 14 includes, as shown in FIG. 3, a rotation shaft portion 17, the regulating portions 18 and 20 and a plurality of projected portions 19 for fixing the toner feeding sheet 13 and the sealing member 15 to the rotatable member 14.

The regulating portions 18 and 20 are regulating portions for regulating the sealing member 15, wound about the rotatable member 14 after the toner supply opening 16 is opened by the rotation of the rotatable member 14, so as to expose a feeding surface of the toner feeding sheet 13. Each of the regulating portions 18 and 20 is provided at a plurality of positions of the rotation shaft portion 17 of the rotatable member 14 and has an outer configuration longer than a maximum distance from a rotation center of the rotation shaft portion 17 to an outer peripheral surface of the rotation shaft portion 17. Specifically, the regulating portions includes a first winding limiting portion (regulating portion) 18 having a projected shape having an outer configuration larger than the rotation shaft portion 17 as seen in the longitudinal direction and a second winding limiting portion (regulating portion) 20 having a projected shape which is provided at each of longitudinal end portions and which is longer than each of the projected portions 19. The plurality of projected portions 19 and the second winding limiting portions 20 are formed on a flat surface 21 which is a fixing surface of the rotatable member 14.

Further, as seen in the longitudinal direction of the developer feeding member 12, the cross-section of the rotation shaft portion 17 in this embodiment is a circular shape of 8 mm in diameter. Each of the first winding limiting portions 18 and the second winding limiting portions 20 has another configuration larger than an outer configuration of the rotation shaft portion 17. Further, a height of each of the second winding limiting portions 20 is higher than a height of each of the plurality of the projected portions 19 for fixing one end portion of each of the toner feeding sheet 13 and the sealing member 15 on the flat surface 21 of the rotation shaft portion 17. Specifically, an outer diameter of each of the first winding limiting portions 18 is 16 mm, the height of each of the projected portions 19 from the flat surface 21 is 1 mm, and the height of each of the second winding limiting portions 20 from the flat surface 21 is 4 mm.

The toner feeding sheet 13 fixed on the rotatable member 14 is formed of a flexible material such as polyethylene terephthalate (PET). The toner feeding sheet 13 having flexibility is not limited thereto, but may also be formed of another flexible material such as polycarbonate (PC) or polyphenylene sulfide (PPS). A length of the developer feeding member 12 of the toner feeding sheet 13 used in this embodiment was 20 mm with respect to the short direction.

As shown in (b) of FIG. 3, the toner feeding sheet 13 rotates in the toner accommodating chamber 41 while contacting the toner accommodating chamber 41. A portion where the toner feeding sheet 13 contacts the toner accommodating chamber 41 is defined as a contact portion X. A length from the contact portion X of the toner feeding sheet 13 with the toner accommodating chamber 41 to a free end of the toner feeding sheet 13 is defined as a penetration amount. Setting was made so that the free end of the toner feeding sheet 13 contacts the toner accommodating chamber 41 with a predetermined penetration amount (3 mm in this embodiment).

The sealing member 15 sealing the toner supply opening 16 in an unsealable manner is constituted by a material having an affinity for a material for the toner accommodating chamber 41 or a material having an adhesive layer. The sealing member 15 is required to have a length such that the sealing member 15 covers the opening 16 and is mountable on the developer feeding member 12 while providing the sealing member 15 with loosening so as not to apply tension to the sealing member 15. For that reason, the length of the developer feeding member 12 of the sealing member 15 used in this embodiment was 58 mm with respect to the short direction.

Next, an assembling method of the developer feeding member 12 will be described. At each of the end portion in the rotation shaft portion side of the sealing member 15 and the end portion in the rotation shaft portion side of the toner feeding sheet 13, a plurality of holes (not shown) are provided. On the other hand, on the flat surface (fixing surface) 21 of the rotatable member 14 having a circular cross-section which is partly flattened, the plurality of projected portions 19 and the plurality of second winding limiting portion 20 are formed.

Then, holes of the sealing member 15 and holes of the toner feeding sheet 13 are successively engaged with the projected portions 19 and the second winding limiting portions 20 of the rotatable member 14. Thereafter, the projected portions 19 of the rotatable member 14 is thermally caulked, so that the sealing member 15 and the toner feeding sheet 13 are integrally fixed on the same flat surface 21 of the rotatable member 14.

In order to prevent the free end (the other end portion) from reaching the contact portion X of the toner feeding sheet 13 with the toner accommodating chamber 41, there is a need to ensure a peripheral length in which the sealing member 15 can be wound about the rotatable member 14. For that reason, mounting phases of the sealing member 15 and the toner feeding sheet 13 are made the same.

The fixing method of the sealing member 15 and the toner feeding sheet 13 to the rotatable member 14 may also be other methods such as welding, snap fitting, fixing using a double-side tape, and thus there is no need to limit the fixing method.

Figure 4:
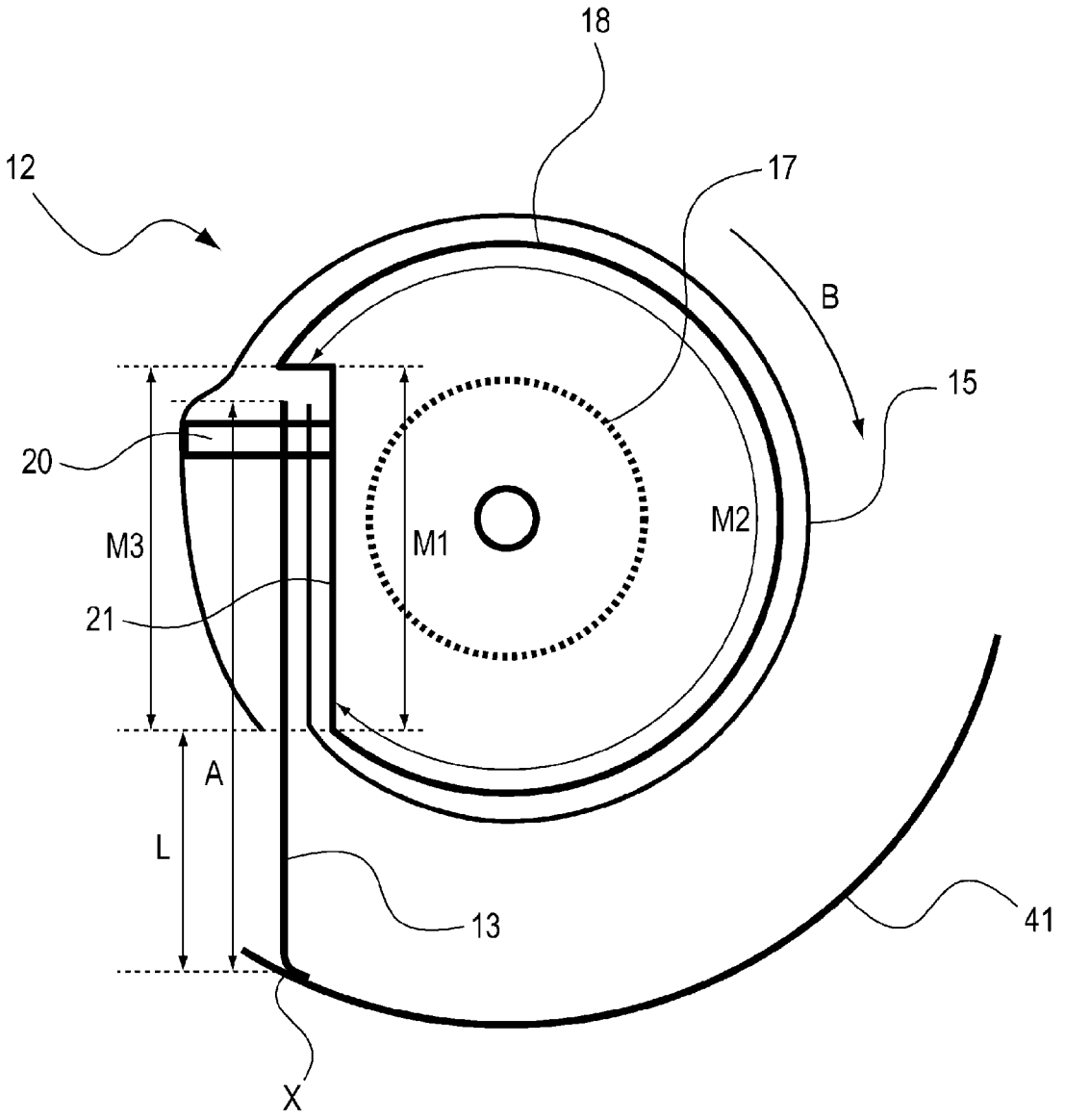
FIG. 4 is an illustration of an outer peripheral portion of the developer feeding member in Embodiment 1.

FIG. 4 is an illustration of an outer peripheral portion of the developer feeding member 12. With reference to (b) of FIG. 3 and FIG. 4, a relative position of the sealing member 15 with respect to the developer feeding member 12 in the latter half lifetime of the process cartridge will be described. As shown in FIG. 4, a constitution in which when the sealing member 15 is wound along the outer peripheral surface of the first winding limiting portions 18 so as to be caught by the free end of the second winding limiting portions 20 by the rotation of the rotatable member 14 in the arrow B direction, the free end of the sealing member 15 does not reach the contact portion X of the toner feeding sheet 13 with the toner accommodating chamber 41 was employed. That is, a constitution in which the sealing member 15 wound about the rotatable member 14 after the opening 16 is opened by the rotation of the rotatable member 14 is regulated (limited) by the first winding limiting portions 18 and the second winding limiting portions 20 so that the feeding surface (region L in FIG. 4) is exposed was employed.

Specifically, when a length of the sealing member 15 at a portion ranging from one end to the other end of the flat surface 21 is M1, a length of the sealing member 15 along the outer peripheral surface of the first winding limiting portions 18 is M2, and a length of the sealing member 15 from a position, where the sealing member 15 is spaced from the outer peripheral surface of the first winding limiting portions 18, to the free end of the sealing member 15 caught by the second winding limiting portions 20 is M3, these lengths M1, M2 and M3 were 10 mm, 38 mm and 10 mm, respectively.

That is, the length of the sealing member 15 opposing the feeding surface of the toner feeding sheet 13 was equal to M3, i.e., 10 mm with respect to the short direction. On the other hand, as for the toner feeding sheet 13, of the length of 20 mm, the toner feeding sheet 13 enters (a phantom shape of) the toner accommodating chamber 41 in an amount of 3 mm, and therefore a short-direction length of a toner feedable surface A is 17 mm.

Therefore, when the length of the toner feeding sheet 13 from the free end of the sealing member 15 to the contact portion X is defined as a toner feeding surface L, L=A−M3 holds. Accordingly, in this embodiment, the toner feeding surface L was 7 mm, so that the toner feeding surface L was 35% of the short-direction length of the toner feeding sheet 13.

Next, verification of an effect of the developer feeding member 12 in this embodiment was made.

Figure 11:
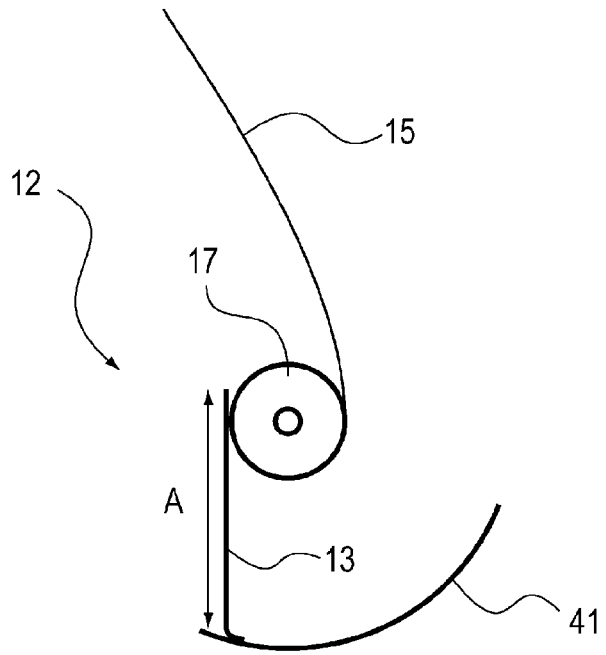
In FIG. 11, (a) and (b) are illustrations of a winding state of a sealing member in Comparison Example.
Figure 11:
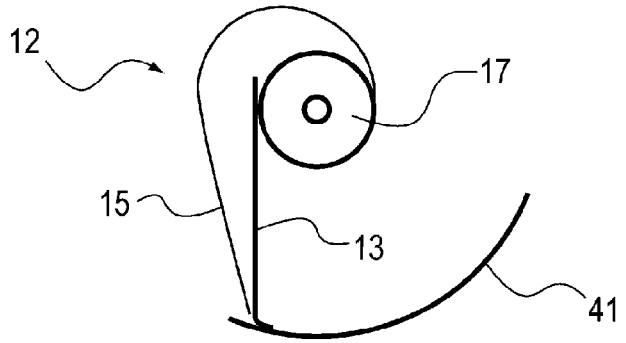

In FIG. 11, (a) and (b) are illustrations of winding states of a sealing member 15 in an initial stage and in the latter half lifetime of a process cartridge in Comparison Example, respectively. In Comparison Example, a developer feeding member 12 which is rotatable and which is constituted by a rotation shaft portion 17 which has a rigidity of not generating flexure (bending) during rotation and which is 8 mm in diameter and by the sealing member 15 and the toner feeding sheet 13 was used.

Figure 6:
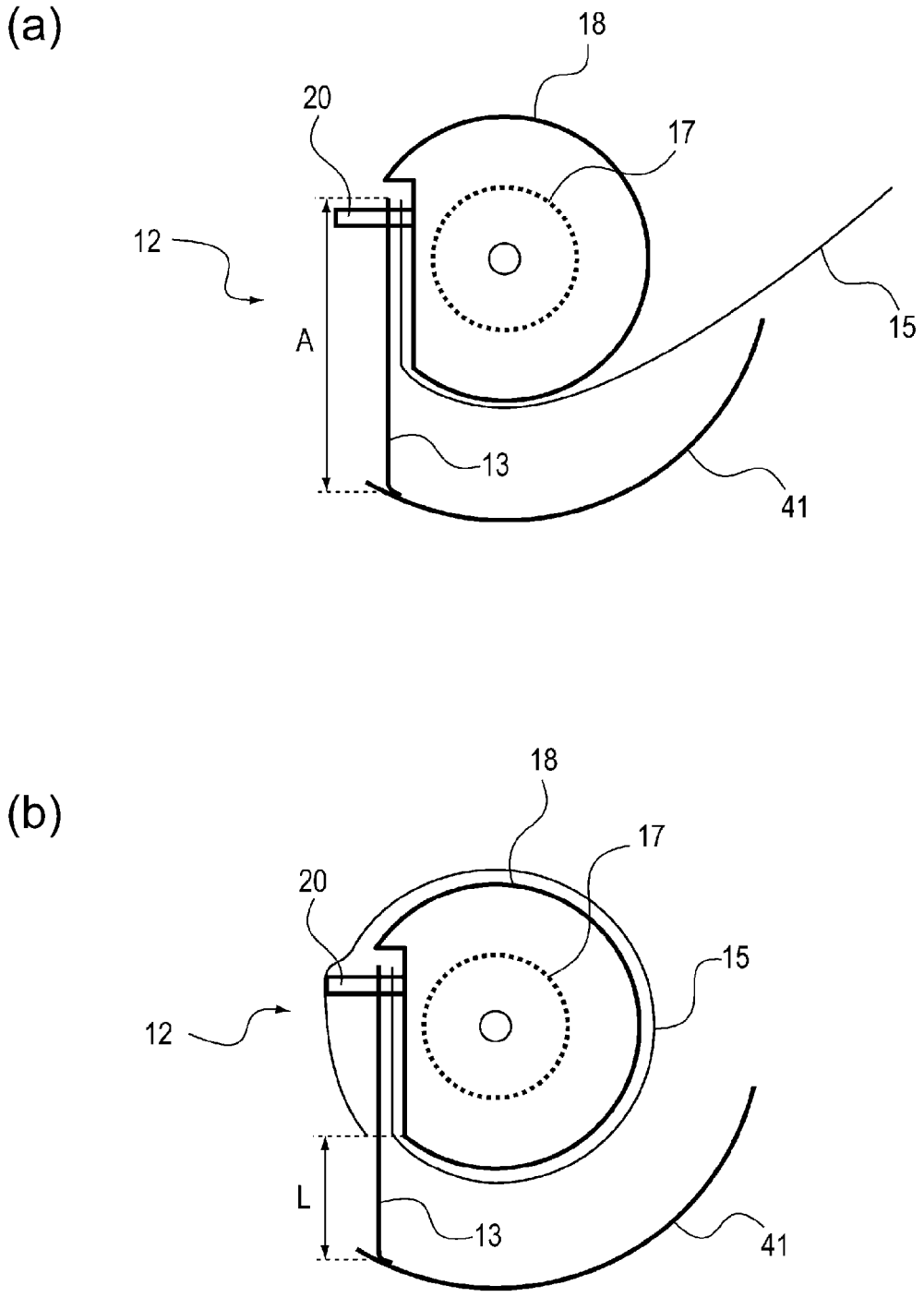
In FIG. 6, (a) and (b) are illustrations of a winding state of the sealing member in Embodiment 1.

In FIG. 6, (a) and (b) are illustrations of winding states of the sealing member 15 in an initial stage and in the latter half lifetime of the process cartridge in this embodiment (Embodiment 1), respectively. In this embodiment, in addition to the constitution of Comparison Example, the developer feeding member 12 includes the first winding limiting portions 18 each having the projected shape of 16 mm in diameter and the second winding limiting portions 20 each having the projected shape of 4 mm in height.

In the initial stage after the sealing member 15 is unsealed, as shown in (a) of FIG. 6 and (a) of FIG. 11, a repelling force of the sealing member 15 is high in both of this embodiment and Comparison Example, and therefore the sealing member 15 is not wound about the developer feeding member 12, so that the sealing member 15 does not cover the toner feeding sheet 13.

Therefore, in both of this embodiment and Comparison Example, the toner feedable surface A is ensured on the toner feeding sheet 13, and therefore the toner feedable surface A is formed as the toner feeding surface L.

On the other hand, in the latter half lifetime, in both of this embodiment and Comparison Example, the sealing member 15 rotates integrally with the developer feeding member 12 while receiving the self-weight G of the toner T, and therefore the repelling force is lowered. As a result, as shown in (b) of FIG. 6 and (b) of FIG. 11, the sealing member 15 is gradually wound about the developer feeding member 12, so that a region where the sealing member 15 covers the toner feedable surface A of the toner feeding sheet 13 gradually increases.

In this embodiment, as described above, the first winding limiting portions 18 and the second winding limiting portions 20 are provided. For that reason, as shown in (b) of FIG. 6, of the toner feedable surface A, the toner feeding surface L where the winding of the sealing member 15 about the rotatable member 14 is limited and where the toner feeding sheet 13 is exposed without being covered with the sealing member 15 is ensured. This toner feeding surface L may only be required to be constituted by an exposed surface where at least a surface at which the toner is fed is exposed. In order to more efficiently feed the toner, the toner feeding surface L may preferably have an exposure length which is 40% to 20% of the length of the toner feeding sheet 13 with respect to a direction perpendicular to the rotation shaft.

On the other hand, in Comparison Example, the peripheral length in which the sealing member 15 is wound about the rotatable member 14 is not ensured. For that reason, as shown in (b) of FIG. 11, the free end of the sealing member 15 does not reach the free end of the toner feeding sheet 13, but covers the entirety of the toner feedable surface A of the toner feeding sheet 13, so that the toner feeding surface L was unable to be ensured.

Figure 7:
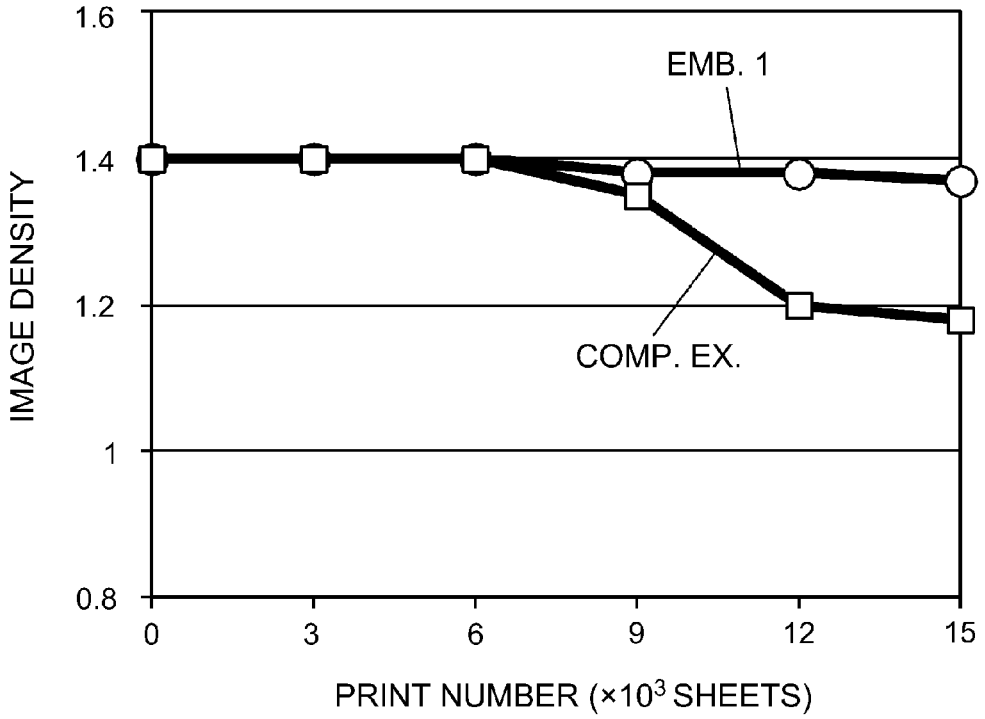
FIG. 7 is a graph showing progression of an image density in Embodiment 1 and Comparison Example.

FIG. 7 shows a progression of an image density in each of Embodiment 1 and Comparison Example. The image density was measured as a relative density with respect to a white background image portion of 0.00 in original density by using a Macbeth densitometer ("RD918", manufactured by Macbeth Corp.).

As shown in FIG. 7, by employing the constitution of this embodiment (Embodiment 1), a stable image density can be outputted until the print number reaches $15\times10^3$ sheets at which a remaining toner amount in the toner accommodating chamber 41 decreases to a predetermined amount, and also insufficient toner supply in the developing device 4 in the latter half lifetime of the process cartridge was not generated.

On the other hand, in the constitution of Comparison Example, the image density was able to be ensured in the initial stage, but started to lower gradually from the print number of about $9\times10^3$ sheets, so that a poor (low) image density generated at the time of the print number of $12\times10^3$ sheets although the remaining toner amount in the toner accommodating chamber 41 did not decrease to the predetermined amount.

In this case, as shown in (b) of FIG. 11, in the developer feeding member 12, the sealing member 15 covers the entirety of the toner feedable surface A of the toner feeding sheet 13, so that the toner feeding surface L was not ensured, and thus the insufficient toner supply generated.

Therefore, as described in this embodiment, it is possible to ensure the toner feeding surface L of the toner feeding sheet 13 by ensuring the peripheral length in which the sealing member 15 in wound about the rotatable member 14 along the first winding limiting portions 18 and the second winding limiting portions 20.

As a result, while maintaining a necessary length of the sealing member 15, the lowering in feeding power of the toner feeding sheet 13 in the latter half lifetime of the process cartridge is suppressed to eliminate the insufficient toner supply, s that the stable image density can be outputted.

Of the toner feedable surface A of the toner feeding sheet 13, with respect to the toner feeding surface L, when it is possible to ensure the toner feeding surface L which is not less than ¼ of the length from the end portion (fixing end) to the contact portion X of the toner feeding sheet 13, even in the case where the remaining toner amount is small, the toner can be fed, so that it is possible to stabilize the image density throughout the lifetime of the process cartridge.

In Embodiment 1, a constitution in which the regulating portion is divided into the first winding limiting portions 18 and the second winding limiting portions 20 is employed, but the present invention is not limited thereto. For example, the rotation shaft portion 17 may also be a columnar member having a cross-sectional shape equivalent to that of the winding limiting portions.

In Embodiment 1, the first winding limiting portions 18 have the circular shape in cross-section, but the present invention is not limited thereto. For example, the first winding limiting portions 18 may also have another shape such as a polygonal shape if the shape can ensure the outer peripheral portion where the sealing member 15 is wound about the rotatable member 14.

In Embodiment 1, the first winding limiting portions 18 have the same shape and size over the entire longitudinal region thereof, but the present invention is not limited thereto. For example, the first winding limiting portions 18 may also include portions which are partly different in shape and size if the outer peripheral portion where the sealing member 15 is wound about the rotatable member 14 can be ensured by the portion having a longest outer peripheral portion.

In FIG. 1, the second winding limiting portions 20 are disposed at the end portions the flat surface 21 with respect to the longitudinal direction, but the present invention is not limited thereto. For example, the second winding limiting portions 20 may also be disposed at a central portion and the end portions or over the entire longitudinal region. Further, a constitution in which the second winding limiting portions 20 are provided separately from the plurality of projected portions 19 for fixing the toner feeding sheet 13 and the sealing member 15 to the rotation shaft portion 17 is illustrated, but a constitution in which the plurality of projected portions also function as the second winding limiting portions may also be employed.

In Embodiment 1, the toner feeding sheet 13 and the sealing member 15 are fixed to the same projected portions 19, but the present invention is not limited thereto. For example, the toner feeding sheet 13 and the sealing member 15 may also be fixed in different positions if the outer peripheral portion where the sealing member 15 is wound about the rotatable member 14 can be ensured.

In Embodiment 1, a constitution in which the toner feeding sheet 13 rotates in the toner accommodating chamber 41 while contacting the toner accommodating chamber 41 is illustrated, but the present invention is not limited thereto. For example, a constitution in which the toner feeding sheet 13 rotates in the toner accommodating chamber 41 in non-contact with the toner accommodating chamber 41 may also be employed.

In Embodiment 1, the developing method is a jumping developing method is used, but is not limited thereto. For example, a contact developing method may also be used.

In Embodiment 1, as the developer, the one-component magnetic toner T is used, but the present invention is not limited thereto. For example, a two-component toner and a nonmagnetic toner may also be used.

Figure 8:
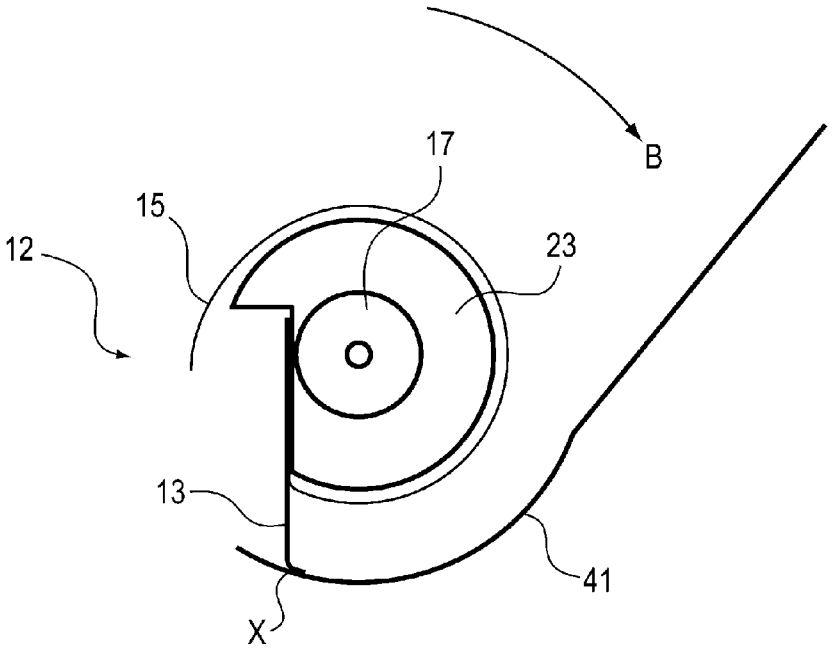
FIG. 8 is a cross-sectional view of the developer feeding member in Embodiment 1 in the case where a winding limiting portion formed of a solid sponge material is provided.
Figure 9:
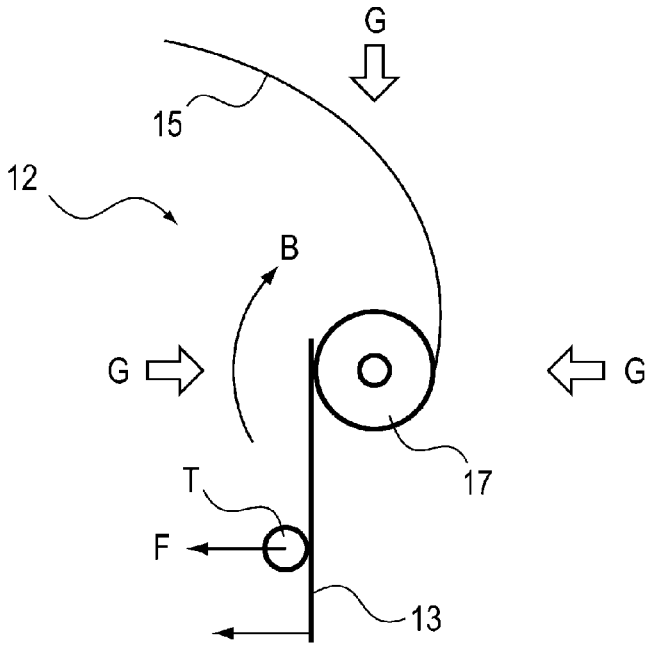
In FIG. 9, (a) and (b) are illustrations of a winding state of the sealing member in an initial stage and in the latter half lifetime, respectively.
Figure 9:
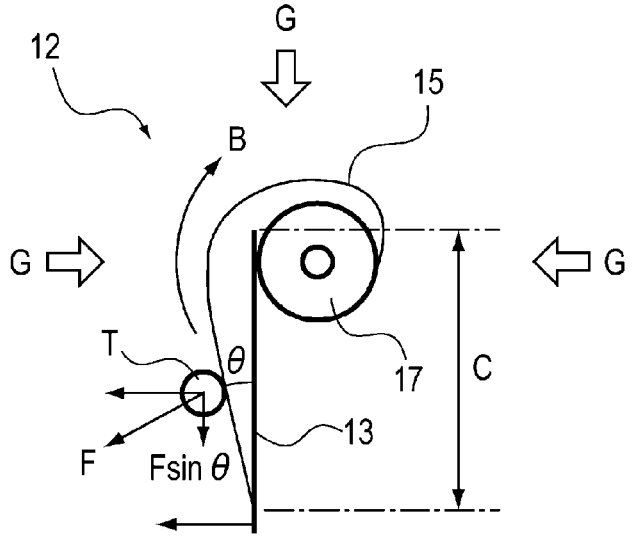

In Embodiment 1, a constitution in which the regulating portions, the first winding limiting portions 18 each having the projected shape are used is illustrated, but the present invention is not limited thereto. For example, as shown in FIG. 8, as the winding limiting portion, a sponge solid foam layer 23 may also be used.

Figure 10:
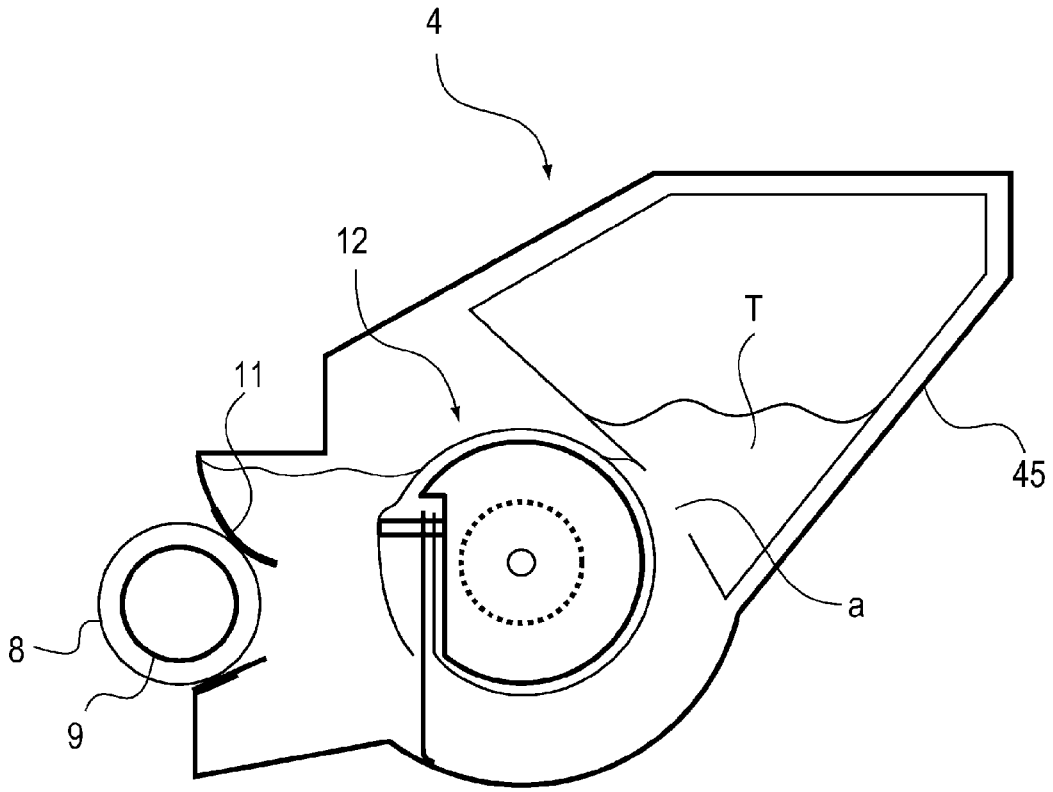
FIG. 10 is a cross-sectional view of a developing device in Embodiment 1 in the case where a developer bag is provided.

In Embodiment 1, the developing device 4 having a constitution in which the toner supply opening 16 provided between the toner accommodating chamber 41 and the toner developing chamber 42 is sealed up with the sealing member 15 is described as an example, but the present invention is not limited thereto. For example, the present invention is also effective in a developing device 4 shown in FIG. 10. The developing device 4 shown in FIG. 10 has a constitution in which as the accommodating chamber, a developer bag 45 which is a flexible container having an opening a for permitting discharge of the toner T accommodated in the developer bag 45 is accommodated in a frame of the developing device 4 is employed. Other constituent members of the developing device 4 are similar to those in Embodiment 1, and therefore the members having functions similar to those in Embodiment 1 are represented by the same reference numerals or symbols and will be omitted from description. The developer container of the developing device 4 shown in FIG. 10 is constituted by the frame, the developer bag 45 and the developer feeding member 12. The developing device 4 is constituted by the developer container, the developing sleeve 8, the developing blade 11 and the toner developing chamber 42. Also in such a constitution, an effect similar to that in Embodiment 1 described above can be obtained by limiting (regulating) the winding of the sealing member 15, for sealing the opening a of the developer bag 45, about the rotatable member 14 by using the regulating portions (limiting portions) 18 and 20.

In Embodiment 1, as the image forming apparatus including the developer container, the printer is illustrated, but the present invention is not limited thereto. For example, the image forming apparatus may also be other image forming apparatuses such as a copying machine, a facsimile machine and a multi-function machine having a combination of functions of these machines. A similar effect can also be obtained by applying the present invention to the developer container used in each of these image forming apparatuses.

According to the present invention, it is possible to suppress the lowering in feeding power of the developer feeding member in the latter half lifetime while maintaining the necessary length of the sealing member. As a result, in sufficient supply of the developer by the developer feeding member is eliminated, so that it is possible to suppress the lowering in image density caused due to the insufficient supply of the developer.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 038084/2014 filed Feb. 28, 2014, which is hereby incorporated by reference.

What is claimed is:

1. A developer container comprising:

an accommodating chamber, provided with an opening for permitting discharge of a developer, for accommodating the developer; and developer feeding means for discharging the developer accommodated in said accommodating chamber through the opening by rotation, wherein said developer feeding means includes:

a rotatable member;

a developer feeding member, fixed on said rotatable member, for discharging the developer accommodated in said accommodating chamber through the opening by rotation of said rotatable member;

a sealing member for opening the opening by the rotation of said rotatable member, wherein one end portion thereof is fixed on said rotatable member and the other end portion thereof is provided so as to seal the opening; and a regulating portion for regulating said sealing member, which is wound about said rotatable member after the opening is opened by the rotation of said rotatable member, so as to expose a feeding surface of said developer feeding member.

2. A developer container according to claim 1, wherein said developer feeding member has flexibility and feeds the developer by contact of a free end thereof with said accommodating chamber.

3. A developer container according to claim 1, wherein said regulating portion is provided on a rotation shaft portion of said rotatable member and has an outer configuration longer than a maximum distance from a rotation center of said rotation shaft portion to an outer peripheral surface, and regulates a degree of winding of said sealing member about said rotatable member so as to expose said feeding surface of said developer feeding member.

4. A developer container according to claim 3, wherein said regulating portion includes:

a first winding limiting portion having a projected shape which has an outer configuration larger than said rotation shaft portion; and a second winding limiting portion having a projected shape formed on a developer feeding member fixing surface of said rotation shaft portion.

5. A developer container according to claim 4, wherein said regulating portion is provided at a plurality of positions with respect to a rotational axis direction of said rotation shaft portion.

6. A developer container according to claim 4, wherein said first winding limiting portion is constituted by a foam layer.

7. A developer container according to claim 1, wherein said sealing member and said developer feeding member are fixed on the same fixing surface of said rotatable member.

8. A developing device comprising:

a developer carrying member for developing, with a developer, a latent image formed on an image bearing member; and a developer container according to claim 1.

9. A process cartridge detachably mountable to an image forming apparatus, said process cartridge comprising:

an image bearing member;

a developer carrying member for developing, with a developer, a latent image formed on said image bearing member; and a developer container according to claim 1.

10. An image forming apparatus comprising:

feeding means for feeding a recording material;

an image bearing member;

a developer carrying member for developing, with a developer, a latent image formed on said image bearing member; and per container according to claim 1.

* * * * *